US010449764B2

(12) United States Patent
Hirai et al.

(10) Patent No.: US 10,449,764 B2
(45) Date of Patent: Oct. 22, 2019

(54) MEMS DEVICE, LIQUID EJECTING HEAD, LIQUID EJECTING APPARATUS, MANUFACTURING METHOD OF MEMS DEVICE, AND MANUFACTURING METHOD OF LIQUID EJECTING HEAD

(71) Applicant: SEIKO EPSON CORPORATION, Tokyo (JP)

(72) Inventors: Eiju Hirai, Azumino (JP); Yoichi Naganuma, Matsumoto (JP); Toshiaki Hamaguchi, Fujimi-machi (JP); Motoki Takabe, Shiojiri (JP)

(73) Assignee: Seiko Epson Corporation, Tokyo (JP)

( * ) Notice: Subject to any disclaimer, the term of this patent is extended or adjusted under 35 U.S.C. 154(b) by 4 days.

(21) Appl. No.: 15/905,370

(22) Filed: Feb. 26, 2018

(65) Prior Publication Data

US 2018/0178517 A1 Jun. 28, 2018

Related U.S. Application Data

(62) Division of application No. 15/258,028, filed on Sep. 7, 2016, now Pat. No. 9,944,077.

(30) Foreign Application Priority Data

Sep. 8, 2015 (JP) ..... 2015-176369

(51) Int. Cl.
*B41J 2/14* (2006.01)
*B41J 2/16* (2006.01)

(52) U.S. Cl.
CPC ..... *B41J 2/14233* (2013.01); *B41J 2/161* (2013.01); *B41J 2/1623* (2013.01); *B41J 2/1629* (2013.01);
(Continued)

(58) Field of Classification Search
CPC ..... B41J 2/14233; B41J 2/161; B41J 2/1646; B41J 2/1623; B41J 2/1629; B41J 2/1631;
(Continued)

(56) References Cited

U.S. PATENT DOCUMENTS 6,332,672 B1 * 12/2001 Yazaki ..... B41J 2/14233 347/70
2003/0025768 A1 2/2003 Koike et al.
(Continued)

FOREIGN PATENT DOCUMENTS

EP 0875380 A2 11/1998
JP 2000289197 A 10/2000
(Continued)

OTHER PUBLICATIONS

Notice of Allowance issued in U.S. Appl. No. 15/258,028 dated Dec. 15, 2017.
(Continued)

*Primary Examiner* — Henok D Legesse
(74) *Attorney, Agent, or Firm* — Workman Nydegger

(57) ABSTRACT

A MEMS device includes a first substrate; a second substrate that is disposed laminated on the first substrate; and a functional element that is disposed between the first substrate and the second substrate, in which the second substrate is smaller than the first substrate, and in planar view, an end portion of the second substrate is disposed inside an end portion of the first substrate.

4 Claims, 11 Drawing Sheets

(52) U.S. Cl.
CPC ..... *B41J 2/1631* (2013.01); *B41J 2/1632* (2013.01); *B41J 2/1634* (2013.01); *B41J 2/1646* (2013.01); *B41J 2002/1425* (2013.01); *B41J 2002/14362* (2013.01); *B41J 2002/14491* (2013.01); *B41J 2202/18* (2013.01)

(58) Field of Classification Search
CPC ..... B41J 2/1632; B41J 2/1634; B41J 2002/1425; B41J 2002/14491; B41J 2002/14362; B41J 2202/18
See application file for complete search history.

(56) References Cited

U.S. PATENT DOCUMENTS

| | | | | |
|---|---|---|---|---|
| 2009/0197393 | A1 | 8/2009 | Haji et al. | |
| 2009/0207213 | A1* | 8/2009 | Tsuda | B41J 2/055 347/70 |
| 2014/0184705 | A1* | 7/2014 | Wakamatsu | B41J 2/1606 347/68 |
| 2014/0267491 | A1 | 10/2014 | Nakao et al. | |
| 2015/0068036 | A1 | 3/2015 | Yaginuma et al. | |
| 2017/0006624 | A1 | 1/2017 | Kim | |
| 2017/0066240 | A1 | 3/2017 | Hirai et al. | |
| 2017/0066241 | A1 | 3/2017 | Naganuma | |
| 2017/0232745 | A1 | 8/2017 | Yaginuma et al. | |

FOREIGN PATENT DOCUMENTS

| | | | |
|---|---|---|---|
| JP | 2002292871 | A | 10/2002 |
| JP | 2005-096230 | A | 4/2005 |
| JP | 2006-108339 | A | 4/2006 |
| JP | 2006-187973 | A | 7/2006 |
| JP | 2007-112092 | A | 5/2007 |
| JP | 2012-114322 | A | 6/2012 |
| JP | 2014051008 | A | 3/2014 |
| JP | 2015-051600 | A | 3/2015 |
| JP | 2015-160360 | A | 9/2015 |

OTHER PUBLICATIONS

Office Action issued in U.S. Appl. No. 15/258,028 dated Sep. 11, 2017.
European Search Report for Application No. 16187614.9 dated Feb. 2, 2017.

* cited by examiner

MEMS DEVICE, LIQUID EJECTING HEAD, LIQUID EJECTING APPARATUS, MANUFACTURING METHOD OF MEMS DEVICE, AND MANUFACTURING METHOD OF LIQUID EJECTING HEAD

CROSS-REFERENCE TO RELATED APPLICATIONS

This application is a divisional of U.S. application Ser. No. 15/258,028 filed Sep. 7, 2016, which claims priority to Japanese Patent Application No. 2015-176369 filed on Sep. 8, 2015, which is hereby incorporated by reference in its entirety.

BACKGROUND

1. Technical Field

The present invention relates to a MEMS device, a liquid ejecting head which is an example of the MEMS device, a liquid ejecting apparatus which is provided with the liquid ejecting head, a manufacturing method of a MEMS device, and a manufacturing method of a liquid ejecting head.

2. Related Art

An ink jet recording head, which is an example of the Micro Electro Mechanical Systems (MEMS) device, has a flow path forming substrate on which a pressure chamber that retains liquid is formed and a functional element (piezoelectric element) that is provided on one surface side of the flow path forming substrate, generates pressure variation in the liquid within the pressure chamber by driving the piezoelectric element, and ejects a liquid droplet from a nozzle that is linked to the pressure chamber.

As such a piezoelectric element, an element is suggested with a thin-film shape that is formed by film deposition and photolithography on the flow path forming substrate. It is possible to dispose the piezoelectric elements at high density by using the thin-film shape piezoelectric elements, on the other hand, electrical connection between the piezoelectric elements that are disposed at high density and a driving circuit is difficult.

For example, an ink jet recording head described in JP-A-2014-51008 has a pressure chamber forming substrate which forms a pressure chamber, a piezoelectric actuator (piezoelectric element) which applies ejection energy to ink within the pressure chamber, and a substrate on which a driver that drives the piezoelectric element is formed. The pressure chamber forming substrate is larger than a substrate on which the driver is formed, the piezoelectric element is blocked from the atmosphere by the pressure chamber forming substrate, the substrate on which the driver is formed, and an adhesive, and moisture-proofing of the piezoelectric element is achieved.

Furthermore, the piezoelectric element and the driving circuit are electrically connected via a bump. It is possible to easily electrically connect the piezoelectric element and the driving circuit even in a case where the piezoelectric elements are disposed at high density by using the bump that electrically connects the piezoelectric element and the driving circuit.

However, in a case where the pressure chamber forming substrate for achieving high density of nozzles that eject liquid is manufactured using a silicon single crystal substrate, and furthermore, the pressure chamber forming substrate for increasing ejectability and ejection precision of liquid is thinned, in the ink jet recording head described in JP-A-2014-51008, there is a problem in that mechanical damage tends to be generated on the pressure chamber forming substrate since the pressure chamber forming substrate is larger than the substrate on which the driver is formed and an end portion of the pressure chamber forming substrate overhangs from an end portion of the substrate on which the driver is formed.

SUMMARY

The invention can be realized in the following aspects or application examples.

Application Example 1

According to this application example, there is provided a MEMS device including a first substrate, a second substrate that is disposed laminated on the first substrate, and a functional element that is disposed between the first substrate and the second substrate, in which the second substrate is smaller than the first substrate, and in planar view, an end portion of the second substrate is disposed inside an end portion of the first substrate.

According to this application example, since the second substrate is smaller than the first substrate, and in planar view, the end portion of the second substrate is disposed inside the end portion of the first substrate, the second substrate is protected by the first substrate and mechanical damage to the second substrate tends not to be generated.

For example, in a case where the MEMS device is manufactured by handling in a state in which the first substrate and the second substrate are joined, since mechanical damage to the second substrate tends not to be generated, it is possible to increase manufacturing yield of the MEMS device and increase quality of the MEMS device.

Application Example 2

In the MEMS device according to the application example, it is preferable that thickness of the first substrate is thinner than the thickness of the second substrate.

When the thickness of the first substrate is thicker than the thickness of the second substrate, in comparison to a case in which the thickness of the first substrate is thinner than the thickness of the second substrate, it is possible to increase mechanical strength of the first substrate and increase resistance with respect to mechanical impact of the first substrate. It is more difficult for the mechanical damage on the second substrate to be generated due to the second substrate being protected by the first substrate on which resistance with respect to mechanical impact is increased.

Application Example 3

In the MEMS device according to the application example, it is preferable for the first substrate to include a driving circuit.

When the driving circuit is formed on the first substrate and the driving circuit is built in to the first substrate, it is possible to thin the MEMS device in comparison to a configuration in which the substrate on which the driving circuit is formed on the first substrate is externally attached (mounted).

Application Example 4

According to this application example, there is provided a liquid ejecting head that is the MEMS device in the described above application example, in which it is preferable that the functional element in the described above application example is a piezoelectric element, the second substrate in the described above application example is a pressure chamber forming substrate that has a through port which is a pressure chamber that is linked to the nozzle, and the liquid ejecting head according to the application example includes a vibration plate which seals an opening of the through port on the first substrate side, and a piezoelectric element that is formed on the surface of the vibration plate on the first substrate side and changes shape of the vibration plate by deflection.

Since the pressure chamber forming substrate is smaller than the first substrate, and in planar view, the end portion of the pressure chamber forming substrate is disposed inside the end portion of the first substrate, the pressure chamber forming substrate is protected by the first substrate and mechanical damage to the pressure chamber forming substrate tends not to be generated.

Furthermore, in the liquid ejecting head according to this application example, pressure variation in the pressure chamber is generated by the piezoelectric element and the vibration plate and it is possible to eject ink from a nozzle by using the pressure variation. Additionally, since mechanical damage to the pressure chamber forming substrate tends not to be generated, it is possible to increase durability of the pressure chamber forming substrate. For example, in a case where the liquid ejecting head is manufactured by handling in a state in which the first substrate and the pressure chamber forming substrate are joined, since mechanical damage to the pressure chamber forming substrate tends not to be generated, it is possible to increase manufacturing yield of the liquid ejecting head and increase quality of the liquid ejecting head.

Application Example 5

According to this application example, there is provided a liquid ejecting apparatus including the liquid ejecting head in the described above application example.

The liquid ejecting head according to this application example increases manufacturing yield and quality. Accordingly, the liquid ejecting apparatus that has the liquid ejecting head in the described above application example also increases manufacturing yield and quality.

Application Example 6

According to this application example, there is provided a manufacturing method of a MEMS device including a first substrate, a second substrate which is disposed laminated on the first substrate, a functional element that is disposed between the first substrate and the second substrate, a third substrate on which a plurality of the first substrates are formed, and a fourth substrate on which a plurality of the second substrates and the functional elements are formed, the method including disposing an adhesive layer between the third substrate and the fourth substrate and joining the third substrate and the fourth substrate, etching the fourth substrate and forming a groove between one second substrate and a second substrate adjacent to the one second substrate, radiating laser light and forming a reforming portion for stealth dicing on the third substrate at a boundary of one first substrate that is disposed inside the groove in planar view and a first substrate adjacent to the one first substrate, bonding an adhesive sheet for stealth dicing to either of the third substrate or the fourth substrate, and dividing the third substrate and the fourth substrate in a state in which, in planar view, an end portion of the second substrate is disposed inside an end portion of the first substrate due to expansion of the adhesive sheet for stealth dicing.

In a state in which the third substrate (mother board) and the fourth substrate (mother board) are joined, a plurality of second substrates are divided into single second substrates by forming a groove in the fourth substrate (mother board) on which the plurality of second substrates are formed. Next, the reforming portion for stealth dicing that is an origin at which the plurality of first substrates are divided into single first substrates is formed on the third substrate (mother board) on which the plurality of first substrates are formed, and the plurality of first substrates are divided into single first substrates by expanding the adhesive sheet for stealth dicing. When the groove forms the end portion of the single second substrate, the reforming portion for stealth dicing forms the end portion of the single first substrate, and the reforming portion for stealth dicing is disposed inside the groove in planar view, the end portion of the single first substrate is in a state of overhanging from the end portion of the single second substrate. Accordingly, according to the manufacturing method according to this application example, it is possible to stably manufacture a substrate pair in a state in which, in planar view, the end portion of the second substrate is disposed inside the end portion of the first substrate by dividing (dividing into individual pieces) in a state in which the single second substrates and the single first substrates are joined from a state in which a plurality of second substrates and a plurality of first substrates are joined.

Furthermore, since a mother board on which a plurality of substrate pairs are formed is divided into individual pieces and the single substrate pair is manufactured, it is possible to increase productivity of the single substrate pair in comparison to a case in which the single substrate pair is manufactured without using the mother board.

Application Example 7

According to this application example, there is provided a manufacturing method of a liquid ejecting head including a first substrate, a pressure chamber forming substrate which is disposed laminated on the first substrate and has a through port that is a pressure chamber that is linked to a nozzle, a vibration plate that seals an opening of the through port on the first substrate side, a piezoelectric element that is formed on a surface of the vibration plate on the first substrate side and changes shape of the vibration plate by deflection, a third substrate on which a plurality of the first substrates are formed, and a fourth substrate on which a plurality of the pressure chamber forming substrates and the piezoelectric elements are formed, the method including disposing an adhesive layer between the third substrate and the fourth substrate and joining the third substrate and the fourth substrate, etching the fourth substrate and forming a groove between one pressure chamber forming substrate and a pressure chamber forming substrate adjacent to the one pressure chamber forming substrate, radiating laser light and forming a reforming portion for stealth dicing on the third substrate at a boundary of one first substrate that is disposed inside the groove in planar view and a first substrate adjacent to the one first substrate, bonding an adhesive sheet for stealth dicing to either of the third substrate or the fourth substrate, and dividing the third substrate and the fourth substrate in a state in which, in planar view, an end portion of the pressure chamber forming substrate is disposed inside an end portion of the first substrate due to expansion of the adhesive sheet for stealth dicing.

In a state in which the third substrate (mother board) and the fourth substrate (mother board) are joined, a plurality of pressure chamber forming substrates are divided into single pressure chamber forming substrates by forming a groove in the fourth substrate (mother board) on which the plurality of pressure chamber forming substrates are formed. Next, the reforming portion for stealth dicing that is an origin at which the plurality of first substrates are divided into single first substrates is formed on the third substrate (mother board) on which the plurality of first substrates are formed, and the plurality of first substrates are divided into single first substrates by expanding the adhesive sheet for stealth dicing. When the groove forms the end portion of the single pressure chamber forming substrate, the reforming portion for stealth dicing forms the end portion of the single first substrate, and the reforming portion for stealth dicing is disposed inside the groove in planar view, the end portion of the single first substrate is in a state of overhanging from the end portion of the single pressure chamber forming substrate. Accordingly, according to the manufacturing method according to this application example, it is possible to stably manufacture a substrate pair in a state in which, in planar view, the end portion of the pressure chamber forming substrate is disposed inside the end portion of the first substrate by dividing (dividing into individual pieces) in a state in which the single pressure chamber forming substrates and the single first substrates are joined from a state in which a plurality of pressure chamber forming substrates and a plurality of first substrates are joined.

Furthermore, since a mother board on which a plurality of substrate pairs are formed is divided into individual pieces and the single substrate pair is formed, it is possible to increase productivity of the single substrate pair in comparison to a case in which the single substrate pair is formed without using the mother board.

Application Example 8

In the manufacturing method of a liquid ejecting head according to the application example, in the forming of the groove, it is preferable to collectively form the groove and the through port.

In the manufacturing method according to the application example, since the groove and the through port are collectively formed by etching the fourth substrate, it is possible to simplify the manufacturing process and increase productivity in comparison to a case where the groove and the through port are separately formed.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
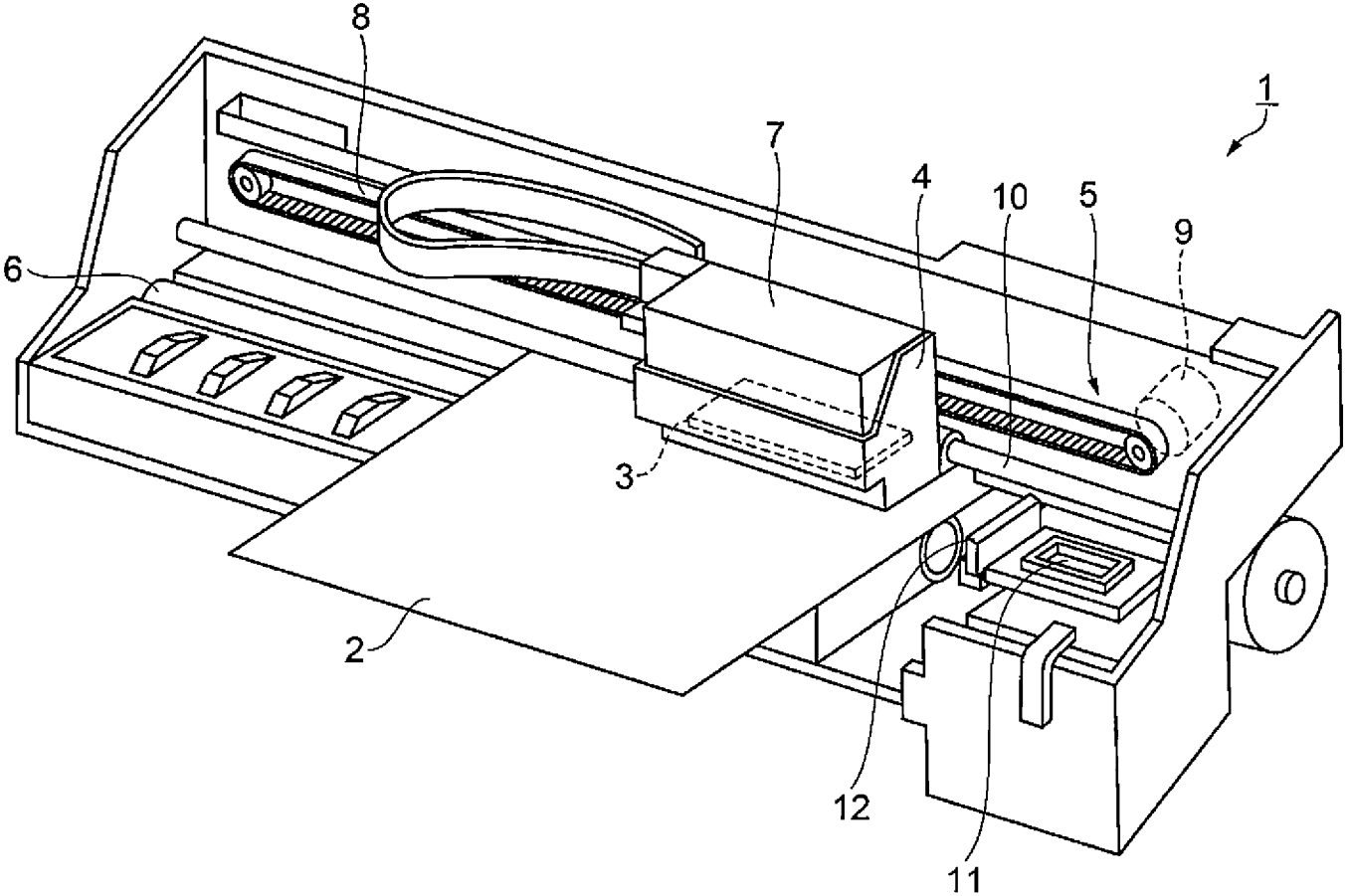
FIG. 1 is a schematic view illustrating a configuration of a printer according to Embodiment 1.

Embodiments of the invention will be described below with reference to the drawings. The present embodiment illustrates an aspect of the invention, but is not limited to the invention, and is able to be arbitrarily modified within the scope of the technical concept of the invention. In addition, in each of the drawings described below, the scale of each layer and each part is different from the actual size in order for the sizes of each layer and each part to be to the extent so as to be recognizable in the drawings.

Embodiment 1

Summary of Printer

FIG. 1 is a schematic view illustrating a configuration of an ink jet recording apparatus (hereinafter, referred to as printer) according to Embodiment 1. To begin with, with reference to FIG. 1, a summary of a printer 1 that is an example of a "liquid ejecting apparatus" will be described.

The printer 1 according to the embodiment is an apparatus that ejects ink that is an example of "liquid" on a recording medium 2 such as recording paper and performs recording (printing) of an image or the like on the recording medium 2.

As shown in FIG. 1, the printer 1 is provided with a carriage 4 to which the recording head 3 is attached, a carriage moving mechanism 5 which moves the carriage 4 in a main scanning direction, a transport mechanism 6 which transfers the recording medium 2 in a sub-scanning direction, and the like. Here, the ink is retained in an ink cartridge 7 which acts as a liquid supply source. The ink cartridge 7 is mounted so as to be attachable and detachable with respect to the recording head 3.

Note that, the recording head 3 is an example of the "MEMS device" and the "liquid ejecting head". Furthermore, there may be a configuration in which the ink cartridge is disposed at a printer main body side, and ink is supplied from the ink cartridge to the recording head 3 through an ink supply tube.

The carriage moving mechanism 5 is provided with a timing belt 8 and is driven by a pulse motor 9 such as a DC motor. When the pulse motor 9 is operated, the carriage 4 is guided on a guide rod 10 which is installed in the printer 1 and reciprocally moves in the main scanning direction (width direction of the recording medium 2). The position of the carriage 4 in the main scanning direction is detected by a linear encoder (illustration omitted) that is a type of positional information detecting means. The linear encoder transmits a detection signal, that is, an encoder pulse to a control portion of the printer 1.

In addition, a home position that is a reference point of a scan of the carriage 4 is set on an end portion region further on the outside than the recording surface within a movement range of the carriage 4. A cap 11 that seals a nozzle 22 (refer to FIG. 2) that is formed on a nozzle surface (nozzle plate 21 (refer to FIG. 2)) of the recording head 3 and a wiping unit 12 that wipes the nozzle surface are disposed in order from the end section side at the home position.

Recording Head Summary

Figure 2:
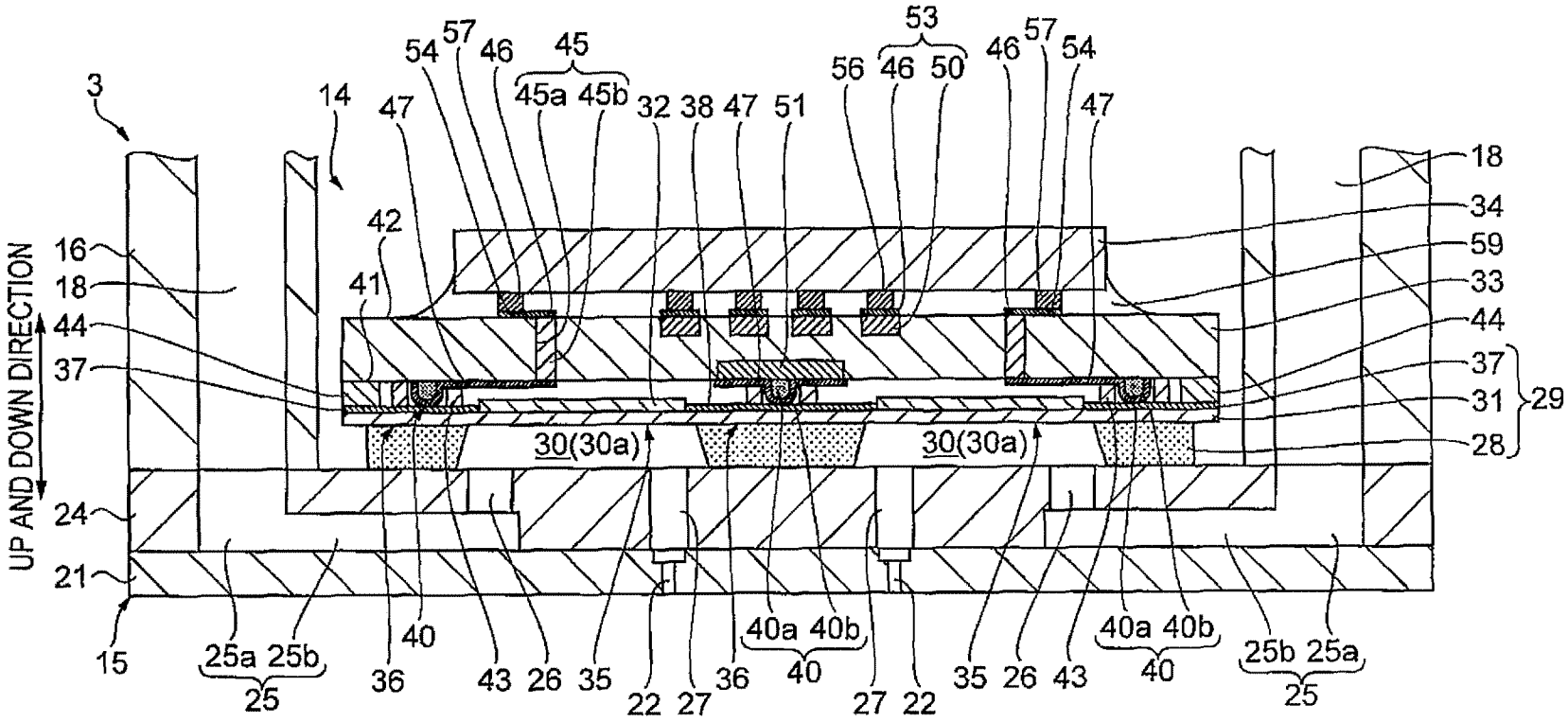
FIG. 2 is a schematic sectional view illustrating a configuration of a recording head according to Embodiment 1.

FIG. 2 is a schematic sectional view illustrating a configuration of a recording head according to the embodiment.

Next, a summary of the recording head 3 will be described with reference to FIG. 2.

As shown in FIG. 2, the recording head 3 has a first flow path unit 15, an electronic device 14, and a head case 16. That is, in the recording head 3, the head case 16 is attached in a state in which the first flow path unit 15 and the electronic device 14 are laminated.

Hereafter, a direction in which the first flow path unit 15 and the electronic device 14 are laminated is described as an up and down direction. Furthermore, a view from the up and down direction is referred to as "planar view". That is, "planar view" in the present application is equivalent to a view from an up and down direction in which the first flow path unit 15 and the electronic device 14 are laminated.

The head case 16 is a box-shaped member made of a synthetic resin and forms a reservoir 18 that supplies ink in each pressure chamber 30 to the inner portion of the head case 16. The reservoir 18 is a space in which ink is retained that is common with the plurality of lined up pressure chambers 30, and two reservoirs 18 are formed corresponding to the row of the pressure chambers 30 that are lined up in two rows. Note that, an ink introduction path (illustration omitted) that introduces ink from the ink cartridge 7 side to the reservoir 18 is formed above the head case 16.

The first flow path unit 15 that is joined to the lower surface of the head case 16 has a linking substrate 24 and a nozzle plate 21. The linking substrate 24 is a plate material formed of silicon, and in the embodiment, is manufactured from the silicon single crystal substrate on which a crystal face azimuth on the front surfaces (upper surface and lower surface) is set as a (110) surface. A common liquid chamber 25 in which ink is retained common to each pressure chamber 30 that is linked to the reservoir 18 and an individual linking path 26 that supplies ink from the reservoir 18 via the common liquid chamber 25 individually to each pressure chamber 30 are formed on the linking substrate 24 by etching. The common liquid chamber 25 is a long space portion along a nozzle row direction and is formed in two rows corresponding to the rows of the pressure chambers 30 that are lined up in two rows. The common liquid chamber 25 is configured from a first liquid chamber 25*a* that is passed through in a plate thickness direction of the linking substrate 24 and a second liquid chamber 25*b* which is recessed up to the middle of the plate thickness direction of the linking substrate 24 from the lower surface side toward the upper surface side of the linking substrate 24 and that is formed in a state in which a thin plate portion remains on the upper surface side. A plurality of individual linking paths 26 are formed in the thin plate portion of the second liquid chamber 25*b* along the arrangement direction of the pressure chamber 30 corresponding to the pressure chamber 30. The individual linking path 26 is linked to one end portion in the longitudinal direction of the corresponding pressure chamber 30 in a state in which the linking substrate 24 and the second flow path unit 29 are joined.

In addition, the nozzle linking path 27 that is passed through in a plate thickness direction of the linking substrate 24 is formed on the position corresponding to each nozzle 22 of the linking substrate 24. That is, a plurality of nozzle linking paths 27 are formed along the nozzle row direction corresponding to the nozzle row. The pressure chamber 30 and the nozzle 22 are linked by the nozzle linking path 27. The nozzle linking path 27 is linked to another end portion (end portion on the opposite side from the individual linking path 26 side) in the longitudinal direction of the corresponding pressure chamber 30 in a state in which the linking substrate 24 and the second flow path unit 29 are joined.

The nozzle plate 21 is a substrate formed of silicon (for example, a silicon single crystal substrate) that is joined to the lower surface of the linking substrate (surface on the opposite side from the second flow path unit 29 side). In the embodiment, an opening on the lower surface side of the space that is the common liquid chamber 25 is sealed by the nozzle plate 21. In addition, a plurality of nozzles 22 are established in a straight line shape (row shape) on the nozzle plate 21. In the embodiment, the nozzle rows are formed in two rows which correspond to the rows of the pressure chambers 30 which are formed in two rows. The plurality of established nozzles 22 (nozzle rows) are provided at equal gaps along the sub-scanning direction which is orthogonal to the main scanning direction at a pitch (for example, 600 dpi) corresponding to the dot formation density from the nozzle 22 on one end side up to the nozzle 22 on the other end side.

Note that, the nozzle plate is joined to a region separated from the common liquid chamber to the inside in the linking substrate, and it is also possible to seal the opening on the lower surface side of the space that is the common liquid chamber using, for example, a member such as a compliance sheet that has flexibility. By doing this, the nozzle plate is able to reduce the size of the nozzle plate as much as possible.

The electronic device 14 is a device with a thin film shape that functions as an actuator that generates pressure variation in ink within each pressure chamber 30. That is, in the electronic device 14, pressure variation in ink within each pressure chamber 30 is generated and ink is ejected from the nozzle 22 that is linked to each pressure chamber 30.

The electronic device 14 has a configuration in which the second flow path unit 29, the first substrate 33, and a driving IC 34 are set in units laminated in order. Furthermore, the second flow path unit 29 has a configuration in which the pressure chamber forming substrate 28, the vibration plate 31, and the piezoelectric element 32 are laminated in order.

Note that, the pressure chamber forming substrate 28 is an example of the "second substrate". The piezoelectric element 32 is an example of the "functional element".

The pressure chamber forming substrate 28 is a hard plate material formed of silicon, and is manufactured from the silicon single crystal substrate on which a crystal face azimuth on the front surfaces (upper surface and lower surface) is set as a (110) surface. The pressure chamber forming substrate 28 has a through port 30*a* that is the pressure chamber 30. The through port 30*a* is formed by carrying out anisotropic etching on the silicon single crystal substrate of the face azimuth (110) in the plate thickness direction. The through port 30*a* is a space that is the pressure chamber 30.

Although described later in detail, the first substrate 33 is also made from a hard plate material made of silicon and is disposed laminated on the second flow path unit 29. Furthermore, the vibration plate 31 is disposed so as to cover the pressure chamber forming substrate 28 between the pressure chamber forming substrate 28 and the first substrate 33. The piezoelectric element 32 is disposed between the vibration plate 31 (pressure chamber forming substrate 28) and the first substrate 33.

The pressure chamber forming substrate 28 is smaller than the first substrate 33, and in planar view, the end portion of the pressure chamber forming substrate 28 is disposed inside the end portion of the first substrate 33. In other words, the first substrate 33 is larger than the pressure chamber forming substrate 28, and in planar view, the end portion of the first substrate 33 overhangs from the end portion of the pressure chamber forming substrate 28. That is, the first substrate 33 protects the pressure chamber forming substrate 28 such that mechanical damage is not generated on the pressure chamber forming substrate 28.

In the pressure chamber forming substrate 28 (second substrate 29), an ink flow path is formed in the recording head 3 using the linking substrate 24 and the head case 16. If it is assumed that when the pressure chamber forming substrate 28 is thick and the capacity of the pressure chamber 30 is increased, it is difficult to appropriately control pressure variation of ink within each pressure chamber 30 and ink tends not to be appropriately ejected from the nozzle 22. For this reason, the thickness of the pressure chamber forming substrate 28 is thinner than the thickness of the first substrate 33. That is, the thickness of the first substrate 33 is thicker than the thickness of the pressure chamber forming substrate 28. In detail, the thickness of the pressure chamber forming substrate 28 is smaller than approximately 100 μm and the thickness of the first substrate 33 is larger than approximately 300 μm.

By setting the thickness of the first substrate 33 to be thicker than the thickness of the pressure chamber forming substrate 28, in comparison to a case in which the thickness of the first substrate 33 is thinner than the thickness of the pressure chamber forming substrate 28, it is possible to increase mechanical strength of the first substrate 33 and increase resistance with respect to mechanical impact of the first substrate 33. It is more difficult for the mechanical damage on the pressure chamber forming substrate 28 to be generated due to the pressure chamber forming substrate 28 being protected by the first substrate 33 on which resistance with respect to mechanical impact is increased.

Although described later in detail, for example, when the electronic device 14 (pressure chamber forming substrate 28 and first substrate 33) in manufacturing of the recording head 3 is handled, mechanical impact is applied to the end portion of the pressure chamber forming substrate 28, mechanical damage such as an end portion of the pressure chamber forming substrate 28 being absent tends to be generated, and it is possible to increase manufacturing yield of the recording head 3, and increase quality of the recording head 3.

The vibration plate 31 is a member with a thin film shape which has elasticity, and is laminated on the upper surface (surface on the opposite side from the linking substrate 24 side) of the pressure chamber forming substrate 28. In detail, the vibration plate 31 is a laminate film of a silicon oxide (elastic film) that is formed by subjecting silicon single crystal substrate of the face azimuth (110) to thermal oxidation and zirconium oxide (insulation film) that is formed in a method such as, for example, a sputtering method. The vibration plate 31 covers the pressure chamber forming substrate 28 between the pressure chamber forming substrate 28 and the first substrate 33, and seals one opening of the through port 30*a*.

That is, one opening of the through port 30*a* of the pressure chamber forming substrate 28 is sealed by the vibration plate 31, and another opening of the through port 30*a* of the pressure chamber forming substrate 28 is sealed by the linking substrate 24. A space that is enclosed by the through port 30*a* of the pressure chamber forming substrate 28, the vibration plate 31, and the linking substrate 24 is a pressure chamber 30. The pressure chamber 30 is formed in two rows which correspond to the nozzle rows which are formed in two rows. Each pressure chamber 30 is a long hollow portion (space) in a direction orthogonal to the nozzle row direction, the individual linking path 26 is linked to one end portion in the longitudinal direction, and the nozzle linking path 27 is linked to the other end portion.

A region which corresponds to the pressure chamber 30 on the vibration plate 31 (region in which the vibration plate 31 and the pressure chamber forming substrate 28 do not contact) functions as a displaced portion that is displaced in a direction that is far from the nozzle 22 or in a direction that is close accompanying deflection of the piezoelectric element 32. That is, a region which corresponds to the pressure generating chamber 30 in the vibration plate 31 (region in which the vibration plate 31 and the pressure chamber forming substrate 28 do not contact) is a driving region 35 in which change of shape by deflection is permissible. Meanwhile, a region which is separated from the pressure chamber 30 on the vibration plate 31 (region in which the vibration plate 31 and the pressure chamber forming substrate 28 contact) is a non-driving region 36 in which change of shape by deflection is inhibited.

As described above, the vibration plate 31 is made from an elastic film made from silicon oxide that is formed on the upper surface of the second flow path unit 29 and an insulation film made from zirconium oxide that is formed on the elastic film. Then, the piezoelectric element 32 is laminated in a region (driving region 35) which corresponds to each pressure chamber 30 on the insulation film (surface on the opposite side from the pressure chamber forming substrate 28 side of the vibration plate 31). The piezoelectric element 32 is formed in two rows along the nozzle row direction corresponding to the pressure chambers 30 that are lined up in two rows along the nozzle row direction.

The piezoelectric element 32 is a piezoelectric element of a so-called deflection mode. That is, the piezoelectric element 32 is disposed between the vibration plate 31 (pressure chamber forming substrate 28) and the first substrate 33, and the vibration plate 31 changes shape by deflection. The piezoelectric element 32 is, for example, configured by a lower electrode layer (individual electrode), piezoelectric body layer, and an upper electrode layer (common electrode) laminated in order on the vibration plate 31. When the piezoelectric element 32 applies an electric field according to a potential difference between the lower electrode layer and the upper electrode layer to the piezoelectric body layer, the piezoelectric element 32 changes shape by deflection in the direction that is far from the nozzle 22 or in a direction that is close.

The lower electrode layer which configures the piezoelectric element 32 configures the individual wiring 37 that extends up to the non-driving region 36 further on the outside than the piezoelectric element 32. Meanwhile, the upper electrode layer which configures the piezoelectric element 32 configures a common wiring 38 that extends up to the non-driving region 36 between the rows of the piezoelectric element 32. That is, in the longitudinal direction of the piezoelectric element 32, the individual wiring 37 is formed further on the outside than the piezoelectric element 32, and the common wiring 38 is formed inside. Then, a resin core bump 40 is joined corresponding respectively to the individual wiring 37 and the common wiring 38. Note that, in the embodiment, the common wiring 38 that extends from the piezoelectric element 32 row on one side and the common wiring 38 which extends from the piezoelectric element 32 row on the other side are connected in the non-driving region 36 between rows of the piezoelectric element 32. That is, the common wiring 38 that is common to the both sides of the piezoelectric element 32 is formed in the non-driving region 36 between rows of the piezoelectric element 32.

The first substrate 33 is manufactured from a silicon single crystal substrate of the face azimuth (110) and is disposed by opening a gap with respect to the vibration plate 31 or the piezoelectric element 32. That is, the first substrate 33 is disposed laminated on the pressure chamber forming substrate 28. The driving IC 34 which outputs a signal that drives the piezoelectric element 32 is disposed on the surface (upper surface) 42 on the opposite side from the piezoelectric element 32 of the first substrate 33. The vibration plate 31 on which the piezoelectric element 32 is laminated is disposed with a gap open on the surface (lower surface) 41 on the piezoelectric element 32 side of the first substrate 33.

A plurality of resin core bumps 40 which output a driving signal from the driving IC 34 and the like to the piezoelectric element 32 side are formed on the surface 41 of the first substrate 33. A plurality of resin core bumps 40 are respectively formed along the nozzle row direction at a position which corresponds to one individual wiring 37 that extends up to the outside of one piezoelectric element 32, a position which corresponds to another individual wiring 37 that extends up to the outside of another piezoelectric element 32, and a position which corresponds to the common wiring 38 that is common to the plurality of piezoelectric elements 32 which are formed between rows of both piezoelectric elements 32. Then, each resin core bump 40 is connected to the respective corresponding individual wiring 37 and the common wiring 38.

The resin core bump 40 has elasticity and protrudes from the front surface if the first substrate 33 toward the vibration plate 31 side. In detail, the resin core bump 40 is provided with an inner resin 40*a* that has elasticity and a conductive film 40*b* made from the lower surface side wiring 47 that covers at least one front surface of the inner resin 40*a*. The inner resin 40*a* is formed to protrude along the nozzle row direction on the front surface of the first substrate 33. In addition, a plurality of conductive films 40*b* that conduct to the individual wirings 37 are formed along the nozzle row direction corresponding to the piezoelectric element 32 that are lined up along the nozzle row direction. That is, a plurality of resin core bumps 40 that conduct to the individual wirings 37 are formed along the nozzle row direction. Each conductive film 40*b* is the lower surface side wiring 47 extending inside (to the piezoelectric element 32 side) from the inner resin 40*a*. Then, the end portion on the opposite side from the resin core bump 40 of the lower surface side wiring 47 is connected to a through wiring 45 which will be described later.

A plurality of resin core bumps 40 which correspond to the common wirings 38 are formed on the lower surface side embedded wiring 51 that is embedded on a surface 41 of the first substrate 33. In detail, the inner resin 40*a* is formed along the same direction at a narrower width than a width (dimension of a direction orthogonal to the nozzle row direction) of the lower surface side embedded wiring 51 on the lower surface side embedded wiring 51 that extends along the nozzle row direction. Then, the conductive film 40*b* is formed so as to conduct with the lower surface side embedded wiring 51 that protrudes to both sides in the width direction of the inner resin 40*a* from above the inner resin 40*a*. A plurality of conductive films 40*b* are formed along the nozzle row direction. That is, a plurality of resin core bumps 40 that conduct to the common wirings 38 are formed along the nozzle row direction. Note that, as the inner resin 40*a*, for example, a resin such as a polyimide resin is used. In addition, the lower surface side embedded wiring 51 is made from metal such as copper (Cu).

Such a first substrate 33 and second flow path unit 29 (in detail, the pressure chamber forming substrate 28 on which the vibration plate 31 and the piezoelectric element 32 are laminated) are joined by a photosensitive adhesive 43 that has both thermosettability and photosensitivity in a state of interposing the resin core bump 40. In the embodiment, the photosensitive adhesive 43 is formed on both sides of the inner resin 40*a* of each resin core bump 40 in a direction orthogonal to the nozzle row direction. In addition, each photosensitive adhesive 43 is formed in a band shape along the nozzle row direction in a state of being separated from the resin core bump 40. As the photosensitive adhesive 43, it is favorable to use a resin including as main components, for example, an epoxy resin, an acrylic resin, a phenol resin, a polyimide resin, a silicon resin, and a styrene resin.

Furthermore, the photosensitive adhesive 44 is disposed between the first substrate 33 and the second flow path unit 29, and a photosensitive adhesive 44 also joins the first substrate 33 and the second flow path unit 29. The photosensitive adhesive 44 is formed of the same material and in the same process as the photosensitive adhesive 43. The photosensitive adhesive 44 is disposed between a peripheral edge portion of the first substrate 33 and a peripheral edge portion of the pressure chamber forming substrate 28. The photosensitive adhesive 44 is formed in a frame shape so as to enclose the piezoelectric element 32, suppresses moisture infiltration into the region in which the piezoelectric element 32 is disposed, and suppresses deterioration of the piezoelectric element 32 due to moisture infiltration.

Note that, the photosensitive adhesive 44 is an example of an "adhesive layer".

In addition, a plurality (four in the embodiment) of power supply lines 53 which supply power (for example, VDD1 (power source of a low voltage circuit), VDD2 (power source of a high voltage circuit), VSS1 (power source of a low voltage circuit), and VSS2 (power source of a high voltage circuit)) to the driving IC 34 are formed at the center on the surface 42 of the first substrate 33. Each power supply line 53 extends along the nozzle row direction, that is, the longitudinal direction of the driving IC 34, and is connected to an external power source (illustration omitted) and the like via the wiring board (illustration omitted) such as a flexible cable in the end portion in the longitudinal direction. Then, a power supply bump electrode 56 of the corresponding driving IC 34 is electrically connected on the power supply line 53.

Furthermore, an individual bump electrode 57 of the driving IC 34 is connected to the region on both sides on the surface 42 of the first substrate 33 (region that is separated to the outside from the region in which the power supply line 53 is formed), and an individual connection terminal 54 is formed which inputs a signal from the driving IC 34. The plurality of individual connection terminals 54 are formed along the nozzle row direction corresponding to the piezoelectric element 32. An upper surface side wiring 46 extends from each individual connection terminal 54 toward the inside (piezoelectric element 32 side). The end portion on the opposite side from the individual connection terminal 54 of the upper surface side wiring 46 is connected to a corresponding lower surface side wiring 47 via the through wiring 45.

The through wiring 45 is a wiring which relays between the surface 41 and the surface 42 of the first substrate 33, and is made from a through hole 45*a* that passes through the first substrate 33 in the plate thickness direction and a conductor portion 45*b* that is made from metal and the like that is formed inside the through hole 45*a*. For example, the conductor portion 45*b* is made from metal such as copper (Cu) and is filled inside the through hole 45*a*. A part which is exposed on the opening portion on the surface 41 side of the through hole 45*a* on the conductor portion 45*b* is covered by the corresponding lower surface side wiring 47. Meanwhile, a portion which is exposed on the opening portion on the surface 42 side of the through hole 45*a* on the conductor portion 45*b* is covered by the corresponding upper surface side wiring 46. For this reason, the upper surface side wiring 46 which extends from the individual connection terminal 54 and the lower surface side wiring 47 which extends from the corresponding resin core bump 40 are electrically connected by the through wiring 45. That is, the individual connection terminal 54 and the resin core bump 40 are connected by a series of wiring made from the upper surface side wiring 46, the through wiring 45, and the lower surface side wiring 47. Note that, the conductor portion 45*b* of the through wiring 45 may be formed on any portion inside the through hole 45*a* without it being necessary to be filled within the through hole 45*a*.

The driving IC 34 is an IC chip for driving the piezoelectric element 32, and is laminated on the surface 42 of the first substrate 33 via the adhesive 59 such as an anisotropically-conductive film (ACF). The power supply bump electrode 56 which is connected to the power supply line 53 and the individual bump electrode 57 which is connected to the individual connection terminal 54 are lined up in plurality along the nozzle row direction on the surface on the first substrate 33 side of the driving IC 34. The power (voltage) is supplied to the driving IC 34 from the power supply line 53 by the power supply bump electrode 56.

The driving IC 34 generates a signal (driving signal) for individually driving each piezoelectric element 32. The individual bump electrode 57 is disposed on the output side of the driving IC 34 and a signal from the driving IC 34 is output to the corresponding piezoelectric element 32 via a wiring and the like that is formed on the individual bump electrode 57, the individual connection terminal 54, and the first substrate 33.

Then, in the recording head 3 formed as above, ink from the ink cartridge 7 is introduced into the pressure chamber 30 via the ink introduction path, the reservoir 18, the common liquid chamber 25, and the individual linking path 26. In this state, pressure variation is generated in the pressure chamber 30 by driving the piezoelectric element 32 by supplying the driving signal from the driving IC 34 to the piezoelectric element 32 via each wiring that is formed on the first substrate 33. By using the pressure variation, the recording head 3 ejects the ink droplet from the nozzle 22 via the nozzle linking path 27.

Recording Head Manufacturing Method

Next, the manufacturing method of the recording head 3 according to the embodiment will be described.

Figure 3:
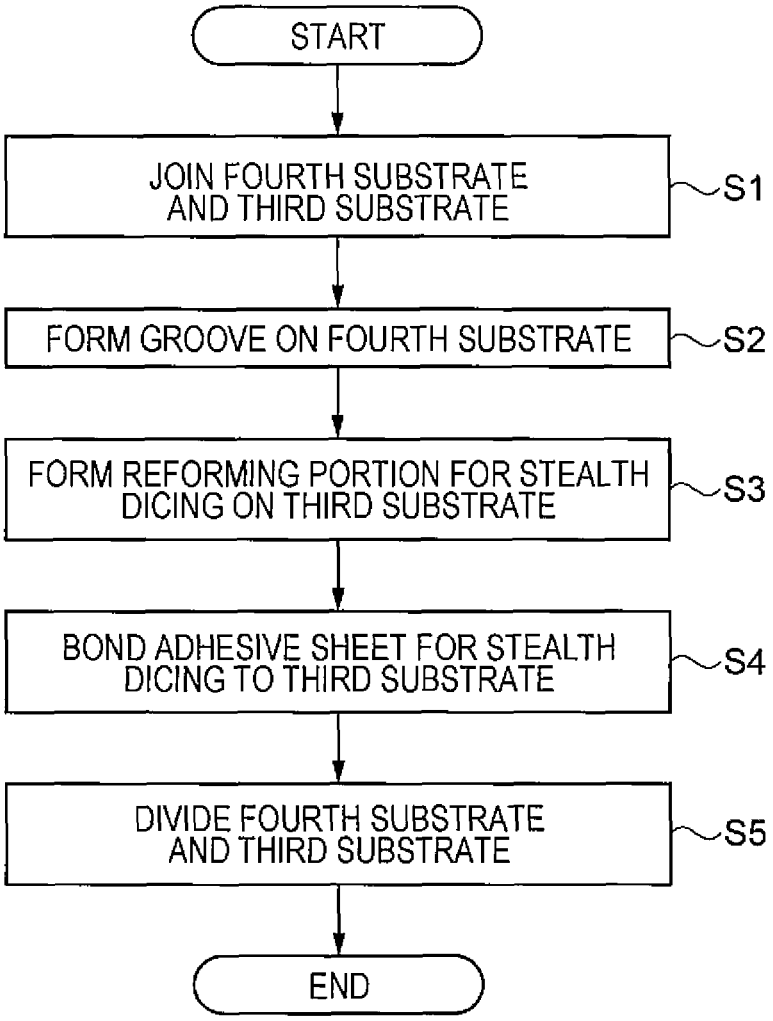
FIG. 3 is a process flow illustrating a manufacturing method of the recording head according to Embodiment 1.

FIG. 3 is a process flow illustrating a manufacturing method of the recording head according to the embodiment.

As shown in FIG. 3, the manufacturing method of the recording head 3 according to the embodiment includes a process (step S1) in which the fourth substrate 71 and the third substrate 82 are joined, a process (step S2) in which the groove 72 is formed in the fourth substrate 71, and a process (step S3) in which the reforming portion for stealth dicing 84 is formed on the third substrate 82, a process (step S4) in which the adhesive sheet for stealth dicing 85 is bonded to the third substrate 82, and a process (step S5) in which the fourth substrate 71 and the third substrate 82 are divided.

Figure 4:
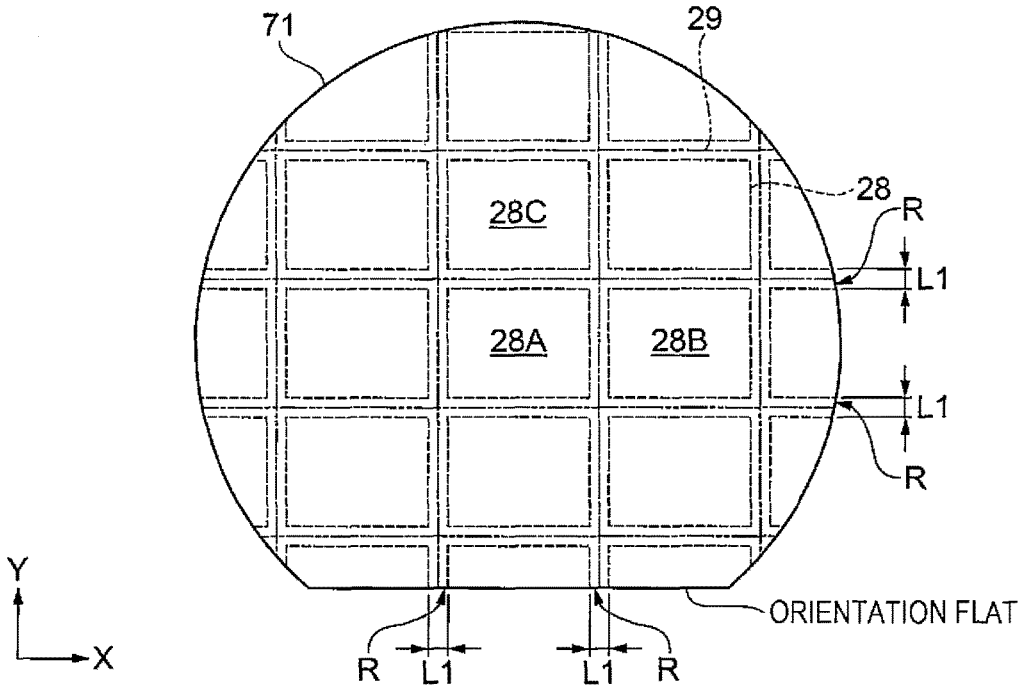
FIG. 4 is a schematic planar view of a fourth substrate.
Figure 5:
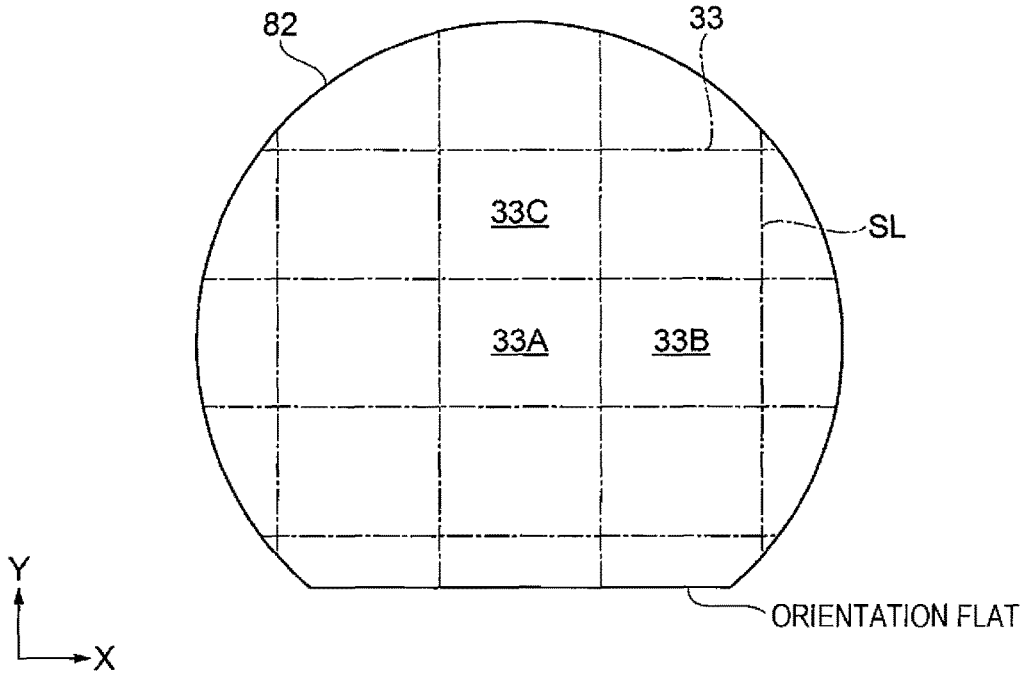
FIG. 5 is a schematic planar view of a third substrate.
Figure 6:
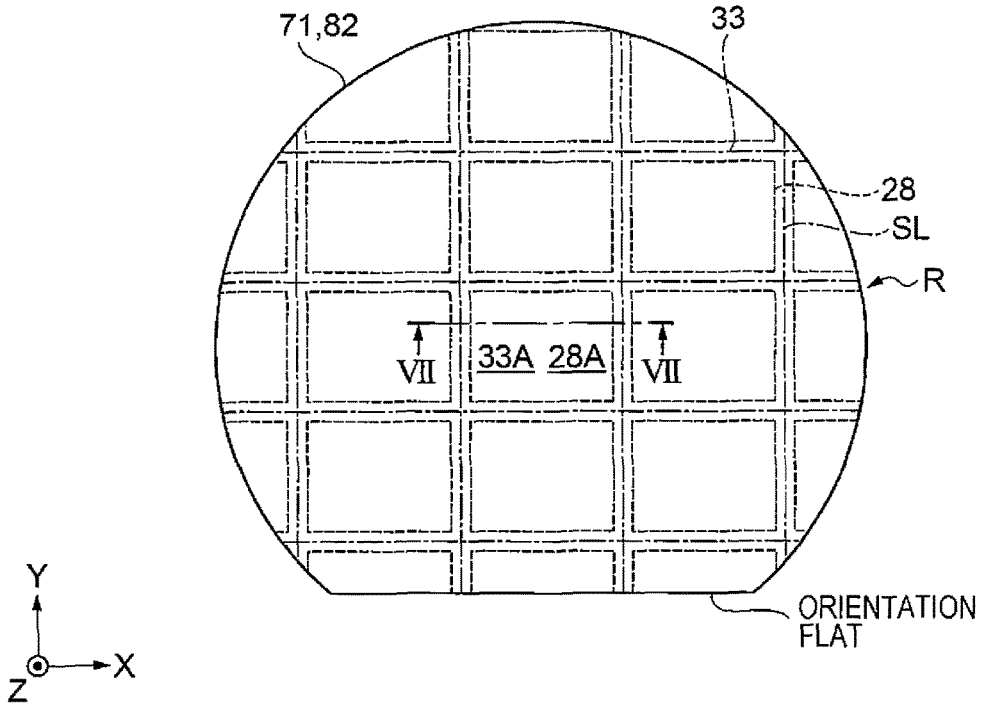
FIG. 6 is a schematic planar view illustrating a state of a substrate after step S1 is over.
Figure 7:
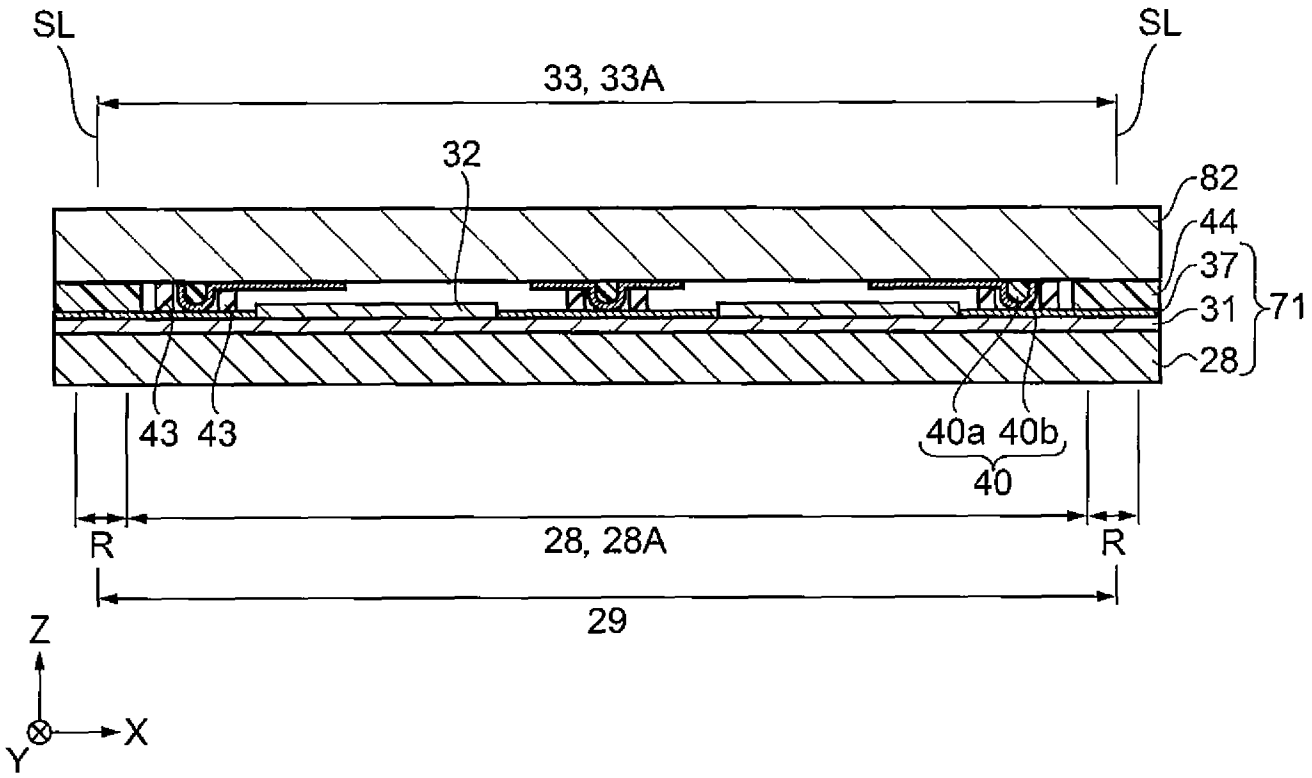
FIG. 7 is a schematic sectional view illustrating a state of a substrate after step S1 is over.

FIG. 4 is a schematic planar view of the fourth substrate. FIG. 5 is a schematic planar view of the third substrate. FIG. 6 is a schematic planar view illustrating a state of a substrate after step S1 is over. In FIG. 6, the fourth substrate 71 is disposed on the lower side, and the third substrate 82 is disposed on the upper side. FIG. 7 is a schematic sectional view along VII-VII in FIG. 6 and illustrating a state of the substrate after step S1 is over.

Note that, in FIG. 4, a broken line indicates a contour of the pressure chamber forming substrate 28, and a two-dot chain line indicates a contour of the second flow path unit 29 (for example, the vibration plate 31). In FIG. 5, a dashed line indicates a contour of the first substrate 33. That is, in FIG. 4, a region that is enclosed by the broken line is a region in which the pressure chamber forming substrate 28 is disposed, and a region which is enclosed by the two-dot chain line is a region in which the second flow path unit 29 (for example, the vibration plate 31) is disposed. In FIG. 5, the region that is enclosed by the dashed line is a region in which the first substrate 33 is disposed.

After step S1 ends, in planar view, since the contour of the second flow path unit 29 (for example, the vibration plate 31) and the contour of the first substrate 33 are disposed to overlap, in FIG. 6, illustration of the contour (two-dot chain line) of the second flow path unit 29 is omitted. Furthermore, in FIGS. 4 to 6, components that are necessary for description are illustrated, and illustration of components that are necessary for description are omitted.

Furthermore, the fourth substrate 71 and the third substrate 82 have flat orientations, the direction along the flat orientation is referred to as the X direction, and the direction that intersects with the X direction is referred to as a Y direction. The direction which intersects with the X direction and the Y direction, that is, a direction from the fourth substrate 71 toward the third substrate 82 is referred to as a Z direction. In addition, the Z direction is a direction (up and down direction) in which the first flow path unit 15 and the electronic device 14 are laminated. Accordingly, viewing from the Z direction is the same as viewing from the up and down direction, and is an example of "planar view".

In addition, there are cases in which a leading end side of an arrow which illustrates a direction is a (+) direction and a base end side of the arrow that indicates the direction refers to a (−) direction.

As shown in FIG. 4, the fourth substrate 71 is a silicon single crystal substrate (mother board) of the face azimuth (110) on which a plurality of second flow path units 29 (plurality of pressure chamber forming substrates 28) are formed. On the fourth substrate 71, the vibration plate 31 is formed over a plurality of pressure chamber forming substrates 28, and the piezoelectric elements 32 are respectively formed on the plurality of pressure chamber forming substrates 28. That is, the fourth substrate 71 has a configuration in which a plurality of pressure chamber forming substrates and piezoelectric elements are formed.

As shown in FIG. 5, the third substrate 82 is a silicon single crystal substrate (mother board) of the face azimuth (110) on which a plurality of first substrates 33 are formed. As described above, the resin core bump 40, the through wiring 45, the upper surface side wiring 46, the lower surface side wiring 47, an upper surface side embedded wiring 50, the lower surface side embedded wiring 51, and the like are formed respectively on the plurality of first substrates 33 (refer to FIG. 2).

In the embodiment, nine second flow path units 29 (pressure chamber forming substrates 28) and nine first substrate 33 are formed on the fourth substrate 71 and the third substrate 82, but the number of second flow path units 29 (pressure chamber forming substrates 28) and first substrates 33 may be lower than nine, and may be more than nine.

Furthermore, the pressure chamber forming substrate 28 which is formed at the center of the fourth substrate 71 is referred to as a pressure chamber forming substrate 28A, the pressure chamber forming substrate 28 which is disposed on the X direction side of the pressure chamber forming substrate 28A is referred to as a pressure chamber forming substrate 28B, and the pressure chamber forming substrate 28 which is disposed on the Y direction side of the pressure chamber forming substrate 28A is referred to as a pressure chamber forming substrate 28C. The first substrate 33 which is formed at the center of the third substrate 82 is referred to as a first substrate 33A, the first substrate 33 which is disposed on the X direction side of the first substrate 33A is referred to as a first substrate 33B, and the first substrate 33 which is disposed on the Y direction side of the first substrate 33A is referred to as a first substrate 33C.

Note that, the pressure chamber forming substrate 28A is an example of "one pressure chamber forming substrate" and "one second substrate", and the pressure chamber forming substrates 28B and 28C are examples of the "pressure chamber forming substrate adjacent to one pressure chamber forming substrate" and "second substrate adjacent to one second substrate". The first substrate 33A is an example of "one first substrate", and the first substrates 33A and 33B are examples of the "first substrate adjacent to one first substrate".

Furthermore, there are cases in which the pressure chamber forming substrate 28A, the pressure chamber forming substrate 28B, and the pressure chamber forming substrate 28C are collectively referred to as the pressure chamber forming substrate 28. There are cases in which the first substrate 33A, the first substrate 33B, and the first substrate 33C are collectively referred to as the first substrate 33.

As shown in FIG. 4, on the fourth substrate 71, a plurality of second flow path units 29 are disposed contacting each other, and a plurality of pressure chamber forming substrates 28 are formed separated from each other. A separation distance between the pressure chamber forming substrate 28A and the pressure chamber forming substrate 28B and a separation distance between the pressure chamber forming substrate 28A and the pressure chamber forming substrate 28C are each L1. That is, the separation distance of the respective plurality of pressure chamber forming substrates 28 is L1.

Hereinafter in the description, a region in which the pressure chamber forming substrate 28 is separated (for example, the region between the pressure chamber forming substrate 28A and the pressure chamber forming substrate 28B, and the region between the pressure chamber forming substrate 28A and the pressure chamber forming substrate 28C) is referred to as a region R. The dimension of the region R in the width direction is L1.

As shown in FIG. 5, on the third substrate 82, a plurality of first substrates 33 are disposed contacting each other. For example, the first substrate 33B is disposed contacting the first substrate 33A, and the first substrate 33C is disposed contacting the first substrate 33A.

Hereinafter in the description, on the third substrate 82, a contour of the respective first substrates 33 (dashed line in the illustration) is referred to as a dividing line SL. The first substrate 33A and the first substrate 33B along with the first substrate 33A and the first substrate 33C are disposed to interpose the dividing line SL.

Note that, the dividing line SL is an example of a "boundary of one first substrate and the first substrate adjacent to the one first substrate".

Although illustration is omitted, in step S1, the photosensitive adhesives 43 and 44 coat the third substrate 82, and patterning is carried out by photolithography, and the photosensitive adhesive 44 is formed in a lattice shape which covers the dividing line SL and the photosensitive adhesive 43 with a band shape is formed close to the inner resin 40*a* of the resin core bump 40.

Next, as shown in FIGS. 6 and 7, the fourth substrate 71 and the third substrate 82 are bonded such that the contour of the second flow path unit 29 and the contour of the first substrate 33 overlap, the photosensitive adhesives 43 and 44 are cured, and the fourth substrate 71 and the third substrate 82 are joined (adhered). That is, the fourth substrate 71 and the third substrate 82 are joined (adhered) such that, in planar view, the end portion of the pressure chamber forming substrate 28 is disposed inside the end portion of the first substrate 33.

Since the dividing line SL is equivalent to the contour of the first substrate 33, and the region R is equivalent to a region in which the pressure chamber forming substrate 28 is separated, in planar view, when the dividing line SL is disposed inside the region R, in planar view, the end portion of the pressure chamber forming substrate 28 is disposed inside the end portion of the first substrate 33.

In other words, step S1 is a process in which the photosensitive adhesive 44 is disposed between the fourth substrate 71 and the third substrate 82, and the fourth substrate 71 and the third substrate 82 are joined.

Furthermore, in step S1, a surface on the Z(−) direction side of the fourth substrate 71 is ground and the fourth substrate 71 is thinned to a predetermined thickness using chemical mechanical polishing (CMP) and a combination of polishing by grinding and etching by a spin etcher. That is, a thinning treatment is carried out such that thickness of the fourth substrate 71 is thinner than the thickness of the third substrate 82.

Note that, in step S1, there may be a configuration in which the fourth substrate 71 that is thinner than the thickness of the third substrate 82 and the third substrate 82 are bonded.

Figure 8:
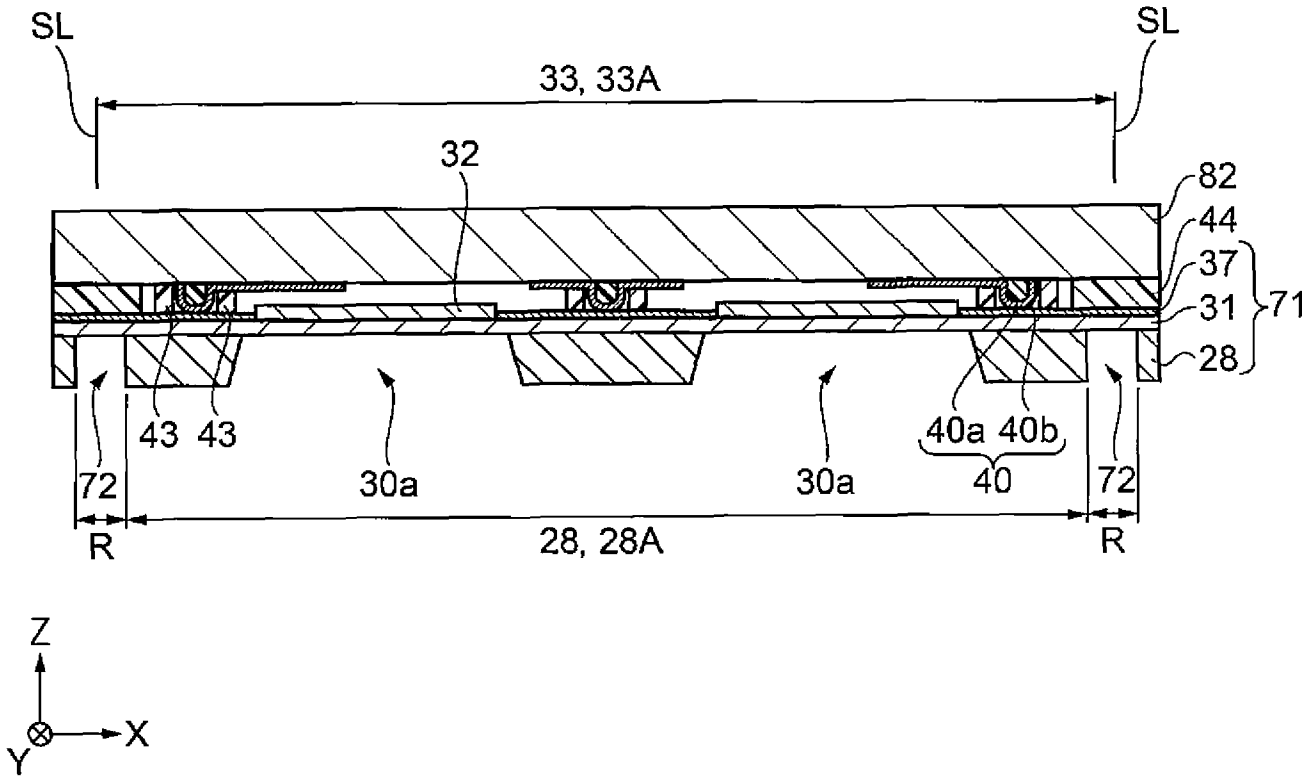
FIG. 8 is a schematic sectional view illustrating a state of a substrate after step S2 is over.
Figure 9:
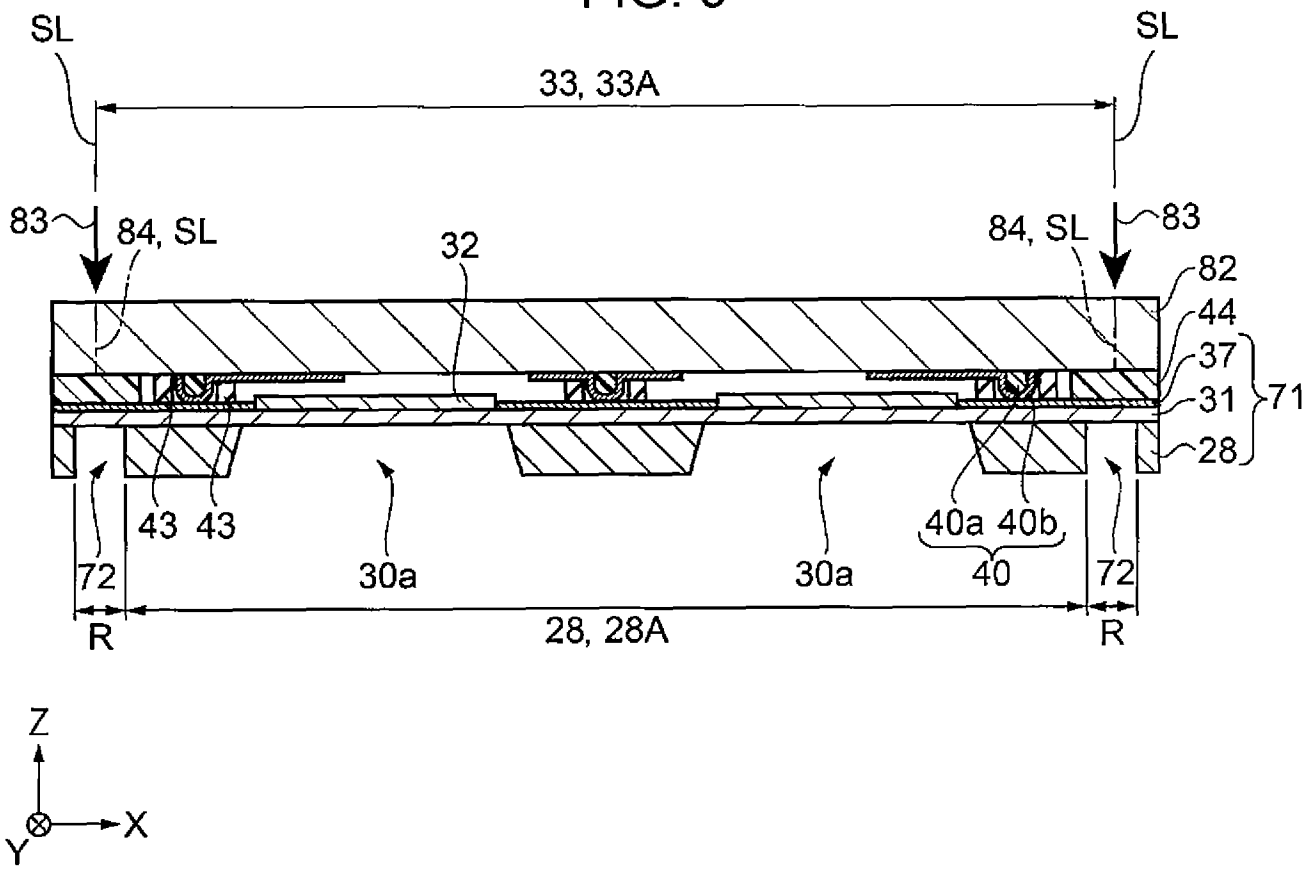
FIG. 9 is a schematic sectional view illustrating a state of a substrate after step S3 is over.
Figure 10:
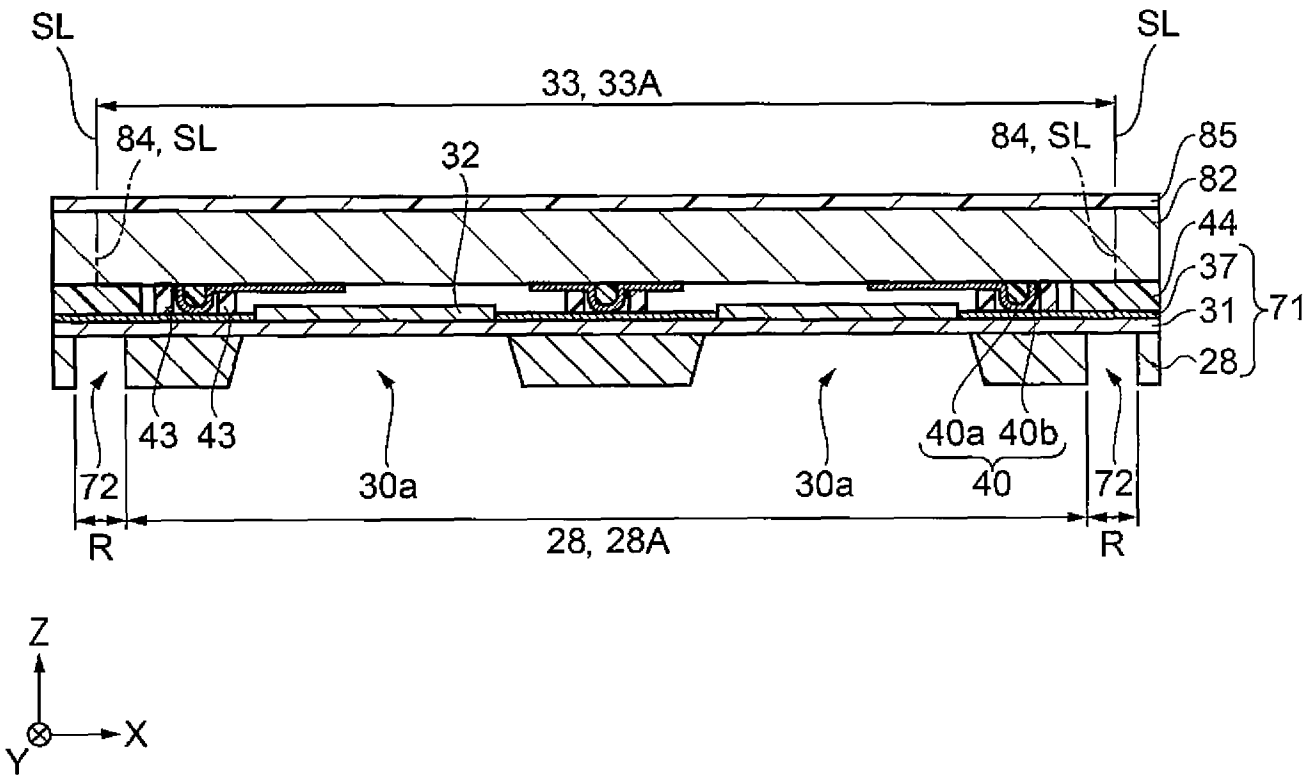
FIG. 10 is a schematic sectional view illustrating a state of a substrate after step S4 is over.
Figure 11:
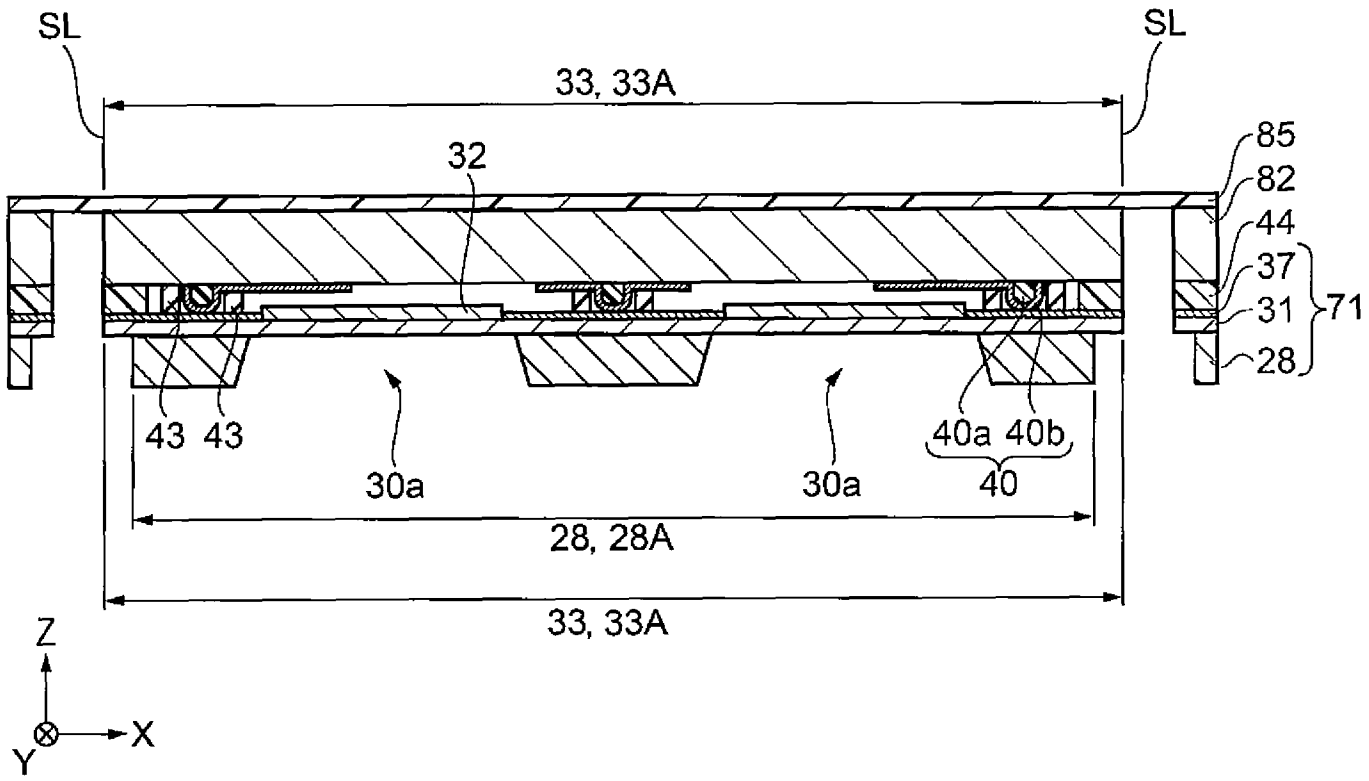
FIG. 11 is a schematic sectional view illustrating a state of a substrate after step S5 is over.

FIG. 8 is a diagram corresponding to FIG. 7 and is a schematic sectional view illustrating a state of the substrate after step S2 is over. FIG. 9 is a diagram corresponding to FIG. 7 and is a schematic sectional view illustrating a state of the substrate after step S3 is over. FIG. 10 is a diagram corresponding to FIG. 7 and is a schematic sectional view illustrating a state of the substrate after step S4 is over. FIG. 11 is a diagram corresponding to FIG. 7 and is a schematic sectional view illustrating a state of the substrate after step S5 is over.

As shown in FIG. 8, in step S2, anisotropic etching is carried out on the surface of the fourth substrate 71 on the Z(−) direction side, and the through port 30*a* and the groove 72 are collectively formed to be partitioned by two (111) surfaces which are orthogonal to the surface (110) of the front surface of the pressure chamber forming substrate 28. For example, wet etching is carried out using KOH, and the through port 30*a* and the groove 72 are collectively formed. In the wet etching using KOH, the pressure chamber surface side of the vibration plate 31 (silicon oxide) is barely etched, and it is possible to selectively etch the pressure chamber forming substrate 28 (silicon).

In step S2, the through port 30*a* is formed by etching the pressure chamber forming substrate 28 in the region corresponding to the pressure chamber 30 in the Z direction. The groove 72 is formed by etching the pressure chamber forming substrate 28 in the region R in the Z direction. When the groove 72 is formed, the pressure chamber forming substrate 28A, the pressure chamber forming substrate 28B, and the pressure chamber forming substrate 28C are respectively divided. That is, step S2 is a process in which selective etching is carried out on the fourth substrate 71 (pressure chamber forming substrate 28) and the plurality of pressure chamber forming substrates 28 are divided into single pressure chamber forming substrates 28. Furthermore in other words, step S2 is a process in which the fourth substrate 71 (pressure chamber forming substrate 28) is etched, and the groove 72 is formed between one pressure chamber forming substrate 28 (pressure chamber forming substrate 28A) and the pressure chamber forming substrate 28 (pressure chamber forming substrates 28B and 28C) adjacent to the one pressure chamber forming substrate (pressure chamber forming substrate 28A).

In step S2, since the through port 30*a* and the groove 72 are collectively formed, it is possible to simplify the manufacturing process in comparison to a case in which the through port 30*a* and the groove 72 are individually formed.

Since the fourth substrate 71 is joined (adhered) to the third substrate 82 by the photosensitive adhesives 43 and 44 and is reinforced by the third substrate 82, even if a space of the groove 72, the through port 30*a*, or the like is formed on the pressure chamber forming substrate 28, mechanical strength of the fourth substrate 71 is lowered, and defects such as the fourth substrate 71 being damaged is suppressed.

As shown in FIG. 9, in step S3, on the surface of the third substrate 82 in the X(+) direction side, laser light 83 that is indicated by an arrow in the drawing along the dividing line SL is irradiated, and the reforming portion for stealth dicing 84 is formed inside the third substrate 82. In detail, the laser light 83 is condensed inside the third substrate 82, and the reforming portion for stealth dicing 84 is formed inside the third substrate 82. The reforming portion for stealth dicing 84 is an origin of segmentation by stealth dicing and is formed along the dividing line SL.

In other words, there is a process in which laser light is irradiated on a boundary (dividing line SL) between one first substrate 33 (first substrate 33A) that, in planar view, is disposed inside the groove 72 and the first substrate 33 (first substrates 33B and 33C) adjacent to the one first substrate 33 (first substrate 33A) and the reforming portion for stealth dicing 84 is formed on the third substrate 82.

As shown in FIG. 10, in step S4, the adhesive sheet for stealth dicing 85 is bonded to the surface of the third substrate 82 on the Z(+) direction side. The adhesive sheet for stealth dicing 85 is a resin sheet that has stretchability, and for example, it is possible to use polyvinyl chloride film.

Note that, step S4 may be configured such that the adhesive sheet for stealth dicing 85 is bonded to the surface of the fourth substrate 71 on the Z(−) direction side. In other words, step S4 is a process in which the adhesive sheet for stealth dicing 85 is bonded to either of the fourth substrate 71 or the third substrate 82.

As shown in FIG. 11, in step S5, the fourth substrate 71 and the third substrate 82 are divided by expanding the adhesive sheet for stealth dicing 85. In detail, the adhesive sheet for stealth dicing 85 is stretched in the direction that intersects with the Z direction, and a force that intersects with the Z direction acts on the third substrate 82. By doing this, the reforming portion for stealth dicing 84 is an origin of segmentation, a plurality of first substrates 33 are segmented along the dividing line SL, and are divided into single first substrates 33. In the same manner, components (for example, the vibration plate 31, the individual wiring 37, the photosensitive adhesive 44, and the like) which are disposed between the pressure chamber forming substrate 28 and the first substrate 33 are also segmented along the dividing line SL.

In step S2, since the plurality of pressure chamber forming substrates 28 are divided into single pressure chamber forming substrates 28, it is possible to divide the plurality of pressure chamber forming substrates 28 and first substrates 33 into single pressure chamber forming substrates 28 and first substrates 33 due to step S5 ending. Furthermore, in step S1, since the fourth substrate 71 and the third substrate 82 are joined such that, in planar view, the end portion of the pressure chamber forming substrate 28 is disposed inside the end portion of the first substrate 33, in planar view, it is possible to dispose the end portion of the pressure chamber forming substrate 28 inside the end portion of the first substrate 33, and stably manufacture the substrate on which the pressure chamber forming substrate 28 and the first substrate 33 are joined by the photosensitive adhesive 44 by dividing the fourth substrate 71 and the third substrate 82 using step S5.

In other words, step S5 is a process in which the fourth substrate 71 and the third substrate 82 are divided in a state in which, in planar view, the end portion of the pressure chamber forming substrate 28 is disposed inside the end portion of the first substrate 33 by expanding the adhesive sheet for stealth dicing 85.

Then, after the adhesive sheet for stealth dicing 85 is removed, the electronic device 14 is manufactured by joining the driving IC 34 using the adhesive 59 on the surface on the Z(+) direction side of the first substrate 33. Furthermore, the recording head 3 is manufactured by joining the head case 16 and the first flow path unit 15 in a state in which the electronic device 14 is accommodated in the head case 16.

In the electronic device 14, since the pressure chamber forming substrate 28 and the first substrate 33 are joined and the pressure chamber forming substrate 28 is protected by the first substrate 33 such that the pressure chamber forming substrate 28 is smaller than the first substrate 33, and in planar view, the end portion of the pressure chamber forming substrate 28 is disposed inside the end portion of the first substrate 33, mechanical damage to the pressure chamber forming substrate 28 tends not to be generated.

Accordingly, in a process in which the adhesive sheet for stealth dicing 85 is removed, a process in which the driving IC 34 is joined, a process in which the head case 16 and the first flow path unit 15 are joined, and the like, even if the electronic device 14 is handled, it is possible to increase manufacturing yield or quality of the recording head 3 in comparison to a case in which mechanical damage such as an end portion of the pressure chamber forming substrate 28 being absent tends not to be generated, and in planar view, the end portion of the pressure chamber forming substrate 28 is disposed outside of the end portion of the first substrate 33.

As described above, the manufacturing method according to the embodiment is able to obtain the effects indicated below.

1) Furthermore, since a mother board (fourth substrate 71 and third substrate 82) on which a plurality of substrates (pressure chamber forming substrates 28 and first substrates 33) are formed is divided into individual pieces and the single substrates (pressure chamber forming substrates 28 and first substrates 33) are formed, it is possible to increase productivity of the single substrates (pressure chamber forming substrates 28 and first substrates 33) in comparison to a case in which the single substrates (pressure chamber forming substrates 28 and first substrates 33) are formed without using the mother board (fourth substrate 71 and third substrate 82).

2) In step S1, after the fourth substrate 71 and the third substrate 82 are joined such that, in planar view, the end portion of the pressure chamber forming substrate 28 is disposed inside the end portion of the first substrate 33, since in step S2, the pressure chamber forming substrate 28 is divided into individual pieces, and in step S5, the first substrate 33 is divided into individual pieces, in planar view, it is possible to dispose the end portion of the pressure chamber forming substrate 28 inside the end portion of the first substrate 33, and stably manufacture the substrate on which the pressure chamber forming substrate 28 and the first substrate 33 are joined by the photosensitive adhesive 44.

3) Since the through port 30*a* of the pressure chamber forming substrate 28 and the groove 72 are formed in the same process (step S2), it is possible to simplify the manufacturing process and increase productivity in comparison to a case in which the through port 30*a* and the groove 72 are formed in separate processes.

4) Even if the pressure chamber forming substrate 28 has a configuration in which mechanical strength is weaker than the first substrate 33 (configuration in which the thickness of the pressure chamber forming substrate 28 is thinner than the thickness of the first substrate 33), since in planar view, the end portion of the pressure chamber forming substrate 28 is disposed inside the end portion of the first substrate 33, and the pressure chamber forming substrate 28 is protected by the first substrate 33, mechanical damage to the pressure chamber forming substrate 28 tends not to be generated. Accordingly, mechanical damage to the pressure chamber forming substrate 28 tends not to be generated by handling of the electronic device 14, and it is possible to increase manufacturing yield of the recording head 3.

Note that, there may be a configuration in which the third substrate 82 is used on which the driving IC 34 is joined in advance, and the processes of step S1 to step S5 are carried out. That is, the driving IC 34 may be joined after the pressure chamber forming substrate 28 and the first substrate 33 are joined, and the driving IC 34 may be joined prior to the pressure chamber forming substrate 28 and the first substrate 33 being joined.

Across the dividing line SL (so as to cover), the photosensitive adhesive 44 is formed in a lattice shape. The photosensitive adhesive 44 may be formed separated from the dividing line SL so as not to cover the dividing line SL. That is, the photosensitive adhesive 44 may be formed by respectively dividing the single pressure chamber forming substrates 28 and the single first substrates 33. For example, in a case where segmentation of the photosensitive adhesive 44 across the dividing line SL is difficult, when the photosensitive adhesive 44 is formed separated from the dividing line SL, it is possible to favorably segment the fourth substrate 71 and the third substrate 82.

Embodiment 2

Figure 12:
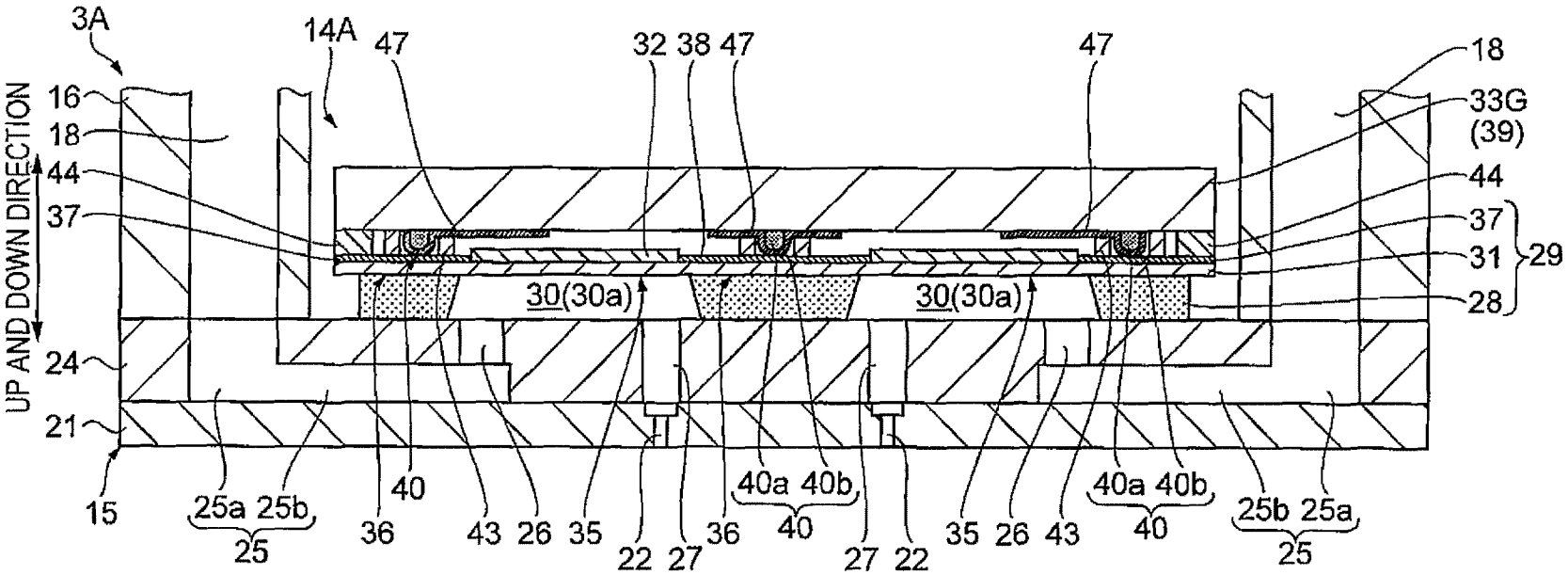
FIG. 12 is a schematic sectional view illustrating a configuration of a recording head according to Embodiment 2.

FIG. 12 is a schematic sectional view illustrating a configuration of a recording head according to Embodiment 2.

In a recording head 3A according to the embodiment, the driving circuit 39 is formed (built in) which drives the piezoelectric element 32 on a first substrate 33G. In the recording head 3 according to Embodiment 1, a driving circuit is formed which drives the piezoelectric element 32 on a separate substrate (driving IC 34) from the first substrate 33. In this point, the recording head 3A according to the embodiment and the recording head 3 according to Embodiment 1 are different, and the other configuration is the same in the embodiment and Embodiment 1.

A summary of the recording head 3A according to the embodiment will be described below focusing on differences from Embodiment 1 with reference to FIG. 12. In addition, the same reference numerals are given for the configuration parts which are the same as in Embodiment 1, and overlapping description is omitted.

As shown in FIG. 12, the recording head 3A has the first flow path unit 15, the electronic device 14A, and the head case 16. The electronic device 14A is a device with a thin film shape that functions as an actuator that generates pressure variation in ink within the pressure chamber 30, and has a configuration in which the second flow path unit 29 and the first substrate 33G are set in units laminated in order. Furthermore, the second flow path unit 29 has a configuration in which the pressure chamber forming substrate 28, the vibration plate 31, and the piezoelectric element 32 are laminated in order.

The pressure chamber forming substrate 28 is manufactured from the silicon single crystal substrate of the face azimuth (110), and has the through port 30*a* that is the pressure chamber 30. The first substrate 33G is a semiconductor circuit board the silicon single crystal substrate as the base material, and is formed by the driving circuit 39. Furthermore, various wirings (illustration omitted), various electrodes (illustration omitted), and the like are formed on the first substrate 33G. The signal from the driving circuit 39 is supplied to the piezoelectric element 32 via the resin core bump 40, and drives the piezoelectric element 32.

Since the pressure chamber forming substrate 28 is smaller than the first substrate 33G, in planar view, the end portion of the pressure chamber forming substrate 28 is disposed inside the end portion of the first substrate 33G, and the pressure chamber forming substrate 28 is protected by the first substrate 33G, mechanical damage to the pressure chamber forming substrate 28 tends not to be generated.

The thickness of the pressure chamber forming substrate 28 is thinner than the thickness of the first substrate 33G, and ink from the nozzle 22 tends to be appropriately ejected. In other words, in comparison to a case in which the thickness of the first substrate 33G is thicker than the thickness of the pressure chamber forming substrate 28 and the thickness of the first substrate 33G is thinner than the thickness of the pressure chamber forming substrate 28, it is possible to increase mechanical strength of the first substrate 33G and increase resistance with respect to mechanical impact of the first substrate 33G. It is difficult for the mechanical damage on the pressure chamber forming substrate 28 to be generated due to the pressure chamber forming substrate 28 being protected by the first substrate 33G on which resistance with respect to mechanical impact is increased.

Accordingly, in the recording head 3A according to the embodiment, in the process in which the recording head 3A is manufactured, when the electronic device 14 (pressure chamber forming substrate 28 and first substrate 33G) is handled, it is possible to obtain the same effects as in Embodiment 1 of mechanical impact being applied to the pressure chamber forming substrate 28, and mechanical impact such as an end portion of the pressure chamber forming substrate 28 being absent tending to be generated.

Furthermore, in the recording head 3A according to the embodiment, since the driving circuit 39 that drives the piezoelectric element 32 is built in to the first substrate 33G, it is possible to thin the recording head 3A in comparison to the recording head 3 according to Embodiment 1 in which a driving circuit which drives the piezoelectric element 32 is formed on a separate substrate (driving IC 34) from the first substrate 33.

Furthermore, the invention widely targets a general head, and it is possible to apply the invention, for example, to a recording head such as various ink jet recording heads which are used in an image recording apparatus such as a printer, a color material ejecting head which is used in manufacture of color filters such as a liquid crystal display, an electrode material ejecting head which is used in electrode formation such as an organic EL display or a field emission display (FED), and a biological substance ejecting head which is used in the manufacture of bio chips, and such are included in the technical scope of the invention.

In addition, the invention widely targets a MEMS device, and it is also possible to apply the invention to a MEMS device other than the recording heads 3 and 3A described above. For example, a surface acoustic wave (SAW) device, an ultrasonic device, a motor, a pressure sensor, a pyroelectric element, and a ferroelectric element are examples of the MEMS device, it is possible to apply the invention thereto, and such are included in the technical scope of the invention.

In addition, a finished body that uses the MEMS devices, for example, a liquid ejecting apparatus that uses the recording heads 3 and 3A, a SAW oscillator that uses the SAW device, an ultrasonic sensor that uses the ultrasonic device, a robot that uses the motor as a driving source, an IR sensor that uses the pyroelectric element, a ferroelectric memory that uses the ferroelectric element, and the like are able to be applied to the invention, and such are included in the technical scope of the invention.

What is claimed is:

1. A MEMS device comprising:

a driving integrated circuit (IC);

a first substrate;

a second substrate that is disposed laminated on the first substrate;

a functional element that is disposed between the first substrate and the second substrate, and a wiring that passes through the first substrate and connects the driving IC and the functional element;

wherein: the second substrate is smaller than the first substrate, in planar view, an end portion of the second substrate is disposed inside an end portion of the first substrate with the first substrate being cantilevered relative to the end portion of the second substrate, and the first substrate is disposed between the driving IC and the functional element.

2. The MEMS device according to claim 1, wherein the thickness of the first substrate is thicker than the thickness of the second substrate.

3. A liquid ejecting head that is the MEMS device according to claim 1, wherein the functional element according to claim 1 is a piezoelectric element, and the second substrate in claim 1 is a pressure chamber forming substrate that has a through port which is the pressure chamber that is linked to the nozzle, and wherein the liquid ejecting head further comprises:

a vibration plate which seals an opening of the through port on the first substrate side; and the piezoelectric element that is formed on the surface of the vibration plate on the first substrate side and changes shape of the vibration plate by deflection.

4. A liquid ejecting apparatus comprising:

the liquid ejecting head according to claim 3.

* * * * *